US008783062B2

(12) United States Patent
Briglia et al.

(10) Patent No.: US 8,783,062 B2
(45) Date of Patent: Jul. 22, 2014

(54) STORAGE ENCLOSURE, METHOD AND APPARATUS FOR PRODUCING CARBON MONOXIDE AND/OR HYDROGEN BY MEANS OF CRYOGENIC SEPARATION, INCLUDING ONE SUCH ENCLOSURE

(75) Inventors: Alain Briglia, Corze (FR); Natacha Haik-Beraud, Champigny-sur-Marne (FR); Antoine Hernandez, Le Plessis-Trevise (FR); Arthur Darde, Paris (FR); Guillaume Teixeira, Paris (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 1019 days.

(21) Appl. No.: 12/600,961

(22) PCT Filed: May 16, 2008

(86) PCT No.: PCT/FR2008/050843

§ 371 (c)(1),
(2), (4) Date: Apr. 20, 2010

(87) PCT Pub. No.: WO2008/142349

PCT Pub. Date: Nov. 27, 2008

(65) Prior Publication Data

US 2010/0199718 A1 Aug. 12, 2010

(30) Foreign Application Priority Data

May 21, 2007 (FR) ..... 07 55165

(51) Int. Cl.
*F25J 3/00* (2006.01)

(52) U.S. Cl.
USPC ..... 62/643; 62/632

(58) Field of Classification Search
USPC ..... 62/630, 632, 643, 45.1, 911, 902
See application file for complete search history.

(56) References Cited

U.S. PATENT DOCUMENTS

| | | | | | |
|---|---|---|---|---|---|
| 2,044,372 | A | * | 6/1936 | Twomey | 165/111 |
| 4,478,621 | A | * | 10/1984 | Fabian | 62/630 |
| 4,606,745 | A | | 8/1986 | Fujita | |
| 4,888,035 | A | | 12/1989 | Bauer | |
| 5,071,458 | A | * | 12/1991 | Grenier et al. | 165/166 |
| 5,133,793 | A | | 7/1992 | Billy | |
| 5,295,356 | A | | 3/1994 | Billy | |
| 5,592,831 | A | | 1/1997 | Bauer et al. | |

(Continued)

FOREIGN PATENT DOCUMENTS

| | | |
|---|---|---|
| DE | 3741906 | 6/1989 |
| FR | 2015667 | 4/1970 |
| JP | S63163771 A | 7/1988 |

OTHER PUBLICATIONS

Ullmann's Encylopedia of Industrial Chemistry, Fifth, Completely Revised Edition, vol. A12, pp. 270-271.

(Continued)

*Primary Examiner* — Frantz Jules
*Assistant Examiner* — Webeshet Mengesha
(74) *Attorney, Agent, or Firm* — Justin K. Murray; Elwood L. Haynes

(57) ABSTRACT

A storage enclosure and an apparatus and method for producing carbon monoxide and/or hydrogen by means of cryogenic separation, including one such enclosure is provided.

16 Claims, 4 Drawing Sheets

(56) References Cited

U.S. PATENT DOCUMENTS

| | | | | |
|---|---|---|---|---|
| 5,617,742 | A * | 4/1997 | Toppel | 62/643 |
| 5,667,005 | A | 9/1997 | Kakutani et al. | |
| 6,062,042 | A | 5/2000 | McNeil et al. | |
| 6,073,461 | A | 6/2000 | McNeil et al. | |
| 6,082,134 | A | 7/2000 | McNeil et al. | |
| 6,094,938 | A | 8/2000 | McNeil et al. | |
| 6,269,657 | B1 | 8/2001 | McNeil | |
| 6,351,968 | B1 * | 3/2002 | Habicht et al. | 62/643 |
| 2002/0134243 | A1 | 9/2002 | Granier | |
| 2006/0075778 | A1 * | 4/2006 | Lehman et al. | 62/643 |
| 2006/0254311 | A1 | 11/2006 | Billy et al. | |
| 2007/0199344 | A1 * | 8/2007 | Howard | 62/620 |

OTHER PUBLICATIONS

Berninger, Ralph, "Progress in H2/CO Low-Temperature Separation," Linde Reports on Science and Technology (pp. 18-23) 44/1988.

Linde Berichte aus Technik und Wissenschaft, "Herstellung Von Kohlenmonoxyd Und Wasserstoff Aus Erdgas," Wiesbaden: Linde Aktiengesellschaft, 1957 (Summary of Reference).

Helmuth Hausen, Hermann Linde, "Tieftemperaturtechnik" (1985).

A. Sloley; "Properly Design Thermosyphon Reboilers"; Chemical Engineering Progress, American Institute of Chemical Engineers, New York, NY, US; Mar. 1, 1997; pp. 52-64; XP001525732; ISSN: 0360-7275.

PCT/FR2008/050843; International Search Report and Written Opinion; Mar. 1, 2013.

* cited by examiner

STORAGE ENCLOSURE, METHOD AND APPARATUS FOR PRODUCING CARBON MONOXIDE AND/OR HYDROGEN BY MEANS OF CRYOGENIC SEPARATION, INCLUDING ONE SUCH ENCLOSURE

This application is a §371 of International PCT Application PCT/FR2008/050843, filed May 16, 2008.

FIELD OF THE INVENTION

The present invention relates to a storage enclosure and an apparatus and method for producing carbon monoxide and/or hydrogen by means of cryogenic separation, including one such enclosure.

BACKGROUND

In a cold box, it is important to have at least one liquid enclosure for controlling the variation in the heat balance of the box. The variations in liquid level thus control the inputs of cold, by liquid injection, by turbine and optionally by cycle.

In various units, this enclosure is divided into several pots, and this potentially reduces the operating flexibility. In other units, this enclosure is dedicated, implying the need for additional equipment.

SUMMARY OF THE INVENTION

The present invention proposes to solve these problems, while having other advantages.

This is done by using the same pot to store the refrigeration capacity and, for example, to accommodate a column condenser. It may also be feasible to use another type of existing enclosure, such as a reboiler, a thermosiphon pot, etc. In the example, the condenser is immersed in cryogenic liquid, which overflows around the condenser above a liquid seal inside the pot, the liquid reserve being located in the annular space around this liquid seal. Hence, there is a single unit under pressure.

According to one object of the invention, a liquid storage enclosure is provided, suitable for inclusion in a cryogenic separation apparatus comprising a chamber, a heat exchanger placed inside the chamber, a barrier dividing the chamber into two parts, the heat exchanger being located in the first part and the second part being arranged around the first part, the barrier having a lower height than the height of the chamber, at least at certain points, for allowing liquid to pass from the first part to the second part over the barrier, when the enclosure is in service, and being optionally sealingly attached to the base of the chamber, means for sending liquid into the first part of the chamber and means for withdrawing liquid from the second part of the chamber and means for sending a fluid to the heat exchanger and for withdrawing a fluid from the heat exchanger.

Optionally:

- the barrier has an essentially cylindrical shape;
- the barrier is coaxial with the chamber;
- no means are provided for sending liquid issuing from outside the chamber directly to the second part;
- means for withdrawing liquid from the second part are not connected to the first part;
- the heat exchanger is located toward the bottom of the chamber;

- the first part of the chamber, when not in use, only contains the heat exchanger and the fluid transport means connected to this heat exchanger.

Thus the second part is only supplied with liquid by the liquid overflow from the first part.

According to another object of the invention, a distillation column is provided comprising a liquid storage enclosure as described above, in which the heat exchanger is a bottom reboiler or a top condenser.

The distillation column is located outside the chamber.

According to another object of the invention, a method is provided for producing carbon monoxide and/or hydrogen by cryogenic separation, comprising an enclosure as described above, said enclosure being included in a separator pot.

According to another object of the invention, an apparatus is provided for producing carbon monoxide and/or hydrogen by cryogenic separation, comprising a column as described above, in which the column is a column for separating carbon monoxide and methane or a column for separating carbon monoxide and nitrogen.

According to other optional aspects, the apparatus comprises:

- means for sending liquid into the first part issuing from at least two different sources and/or means for withdrawing liquid from the second part to send it subsequently to two different destinations;
- a scrub column and means for sending the withdrawn liquid at least to the cooler of the scrub column, for example a scrub column for methane or for carbon monoxide;
- a heat exchange line, means for sending the feed fluid from the apparatus to the heat exchange line to be cooled therein, and means for sending the withdrawn liquid at least to the heat exchange line;
- a column for separating carbon monoxide and methane or a column for separating carbon monoxide and nitrogen and means for sending the withdrawn liquid at least to a top condenser of the column for separating carbon monoxide and methane or the column for separating carbon monoxide and nitrogen;
- a stripping column having a bottom reboiler and means for sending liquid condensed in the bottom reboiler to the first part of the enclosure;
- a column for separating carbon monoxide and nitrogen having a bottom reboiler and means for sending liquid condensed in the bottom reboiler to the first part of the enclosure;
- a column for separating carbon monoxide and methane having a bottom reboiler and means for sending liquid condensed in the bottom reboiler to the first part of the enclosure;
- a heat exchange line and means for sending a liquid from the heat exchange line to the first part of the enclosure.

According to another object of the invention, a method is provided for producing carbon monoxide and/or hydrogen by cryogenic separation in an apparatus comprising an enclosure as described above, said enclosure being included in a separator pot.

According to another object of the invention, a method is provided for producing carbon monoxide and/or hydrogen by cryogenic separation in an apparatus comprising a column as described above, in which the column is a column for separating carbon monoxide and methane or a column for separating carbon monoxide and nitrogen.

According to other optional features:

- the liquid is sent into the first part issuing from at least two different sources and/or liquid is withdrawn from the second part to send it subsequently to two different destinations;
- the apparatus comprises a scrub column and means for sending the withdrawn liquid at least to the cooler of the scrub column;
- the apparatus comprises a heat exchange line, means for sending the feed fluid from the apparatus to the heat exchange line to be cooled therein, and means for sending the withdrawn liquid at least to the heat exchange line;
- the apparatus comprises a column for separating carbon monoxide and methane or a column for separating carbon monoxide and nitrogen and means for sending the withdrawn liquid at least to a top condenser of the column for separating carbon monoxide and methane or the column for separating carbon monoxide and nitrogen;
- the apparatus comprises a stripping column having a bottom reboiler and liquid is sent from the bottom reboiler to the first part of the enclosure;
- the apparatus comprises a column for separating carbon monoxide and nitrogen having a bottom reboiler and liquid is sent from the bottom reboiler to the first part of the enclosure;
- the apparatus comprises a column for separating carbon monoxide and methane having a bottom reboiler and liquid is sent from the bottom reboiler to the first part of the enclosure;
- the apparatus comprises a heat exchange line and liquid is sent from the heat exchange line to the first part of the enclosure;
- most of the liquids, or even all the liquids, of the apparatus substantially having the same composition are sent to a single enclosure.

This apparatus has many advantages.

A single enclosure serves to perform at least two functions: on the one hand, it stores an "independent" refrigerating reserve and, on the other hand, it is required for an element of the method (condenser, heat exchanger thermosiphon, etc.).

This enclosure may be supplied by all the streams producing liquid in the cold box. For example, on a methane scrub apparatus, the enclosure is supplied by at least two high pressure streams passing through the reboilers, the high pressure stream circumventing them. It may be supplied by other streams, at various pressures. The joining of all the streams in a single enclosure adds a great flexibility if various operating cases are to be considered, rather than attributing to each high pressure fluid one or more low pressure uses (thermosiphon, condenser, etc.). In addition to flexibility, standardization is also enhanced. If permitted by the pressure of the enclosure, all the liquid requirements can thus pass through this enclosure.

The overflow makes it impossible to control the condensation capacity (in the example) by the liquid level. However, it is possible to control the energy exchanged in the condenser by controlling the pressure of the enclosure.

In the second part, the liquid reserve serves to control the level by turbine or by liquid injection. This also allows a liquid reserve to operate the apparatus when the turbine is out of order and before starting the liquid injection nitrogen vaporization.

DETAILED DESCRIPTION OF THE INVENTION

Figure 1:
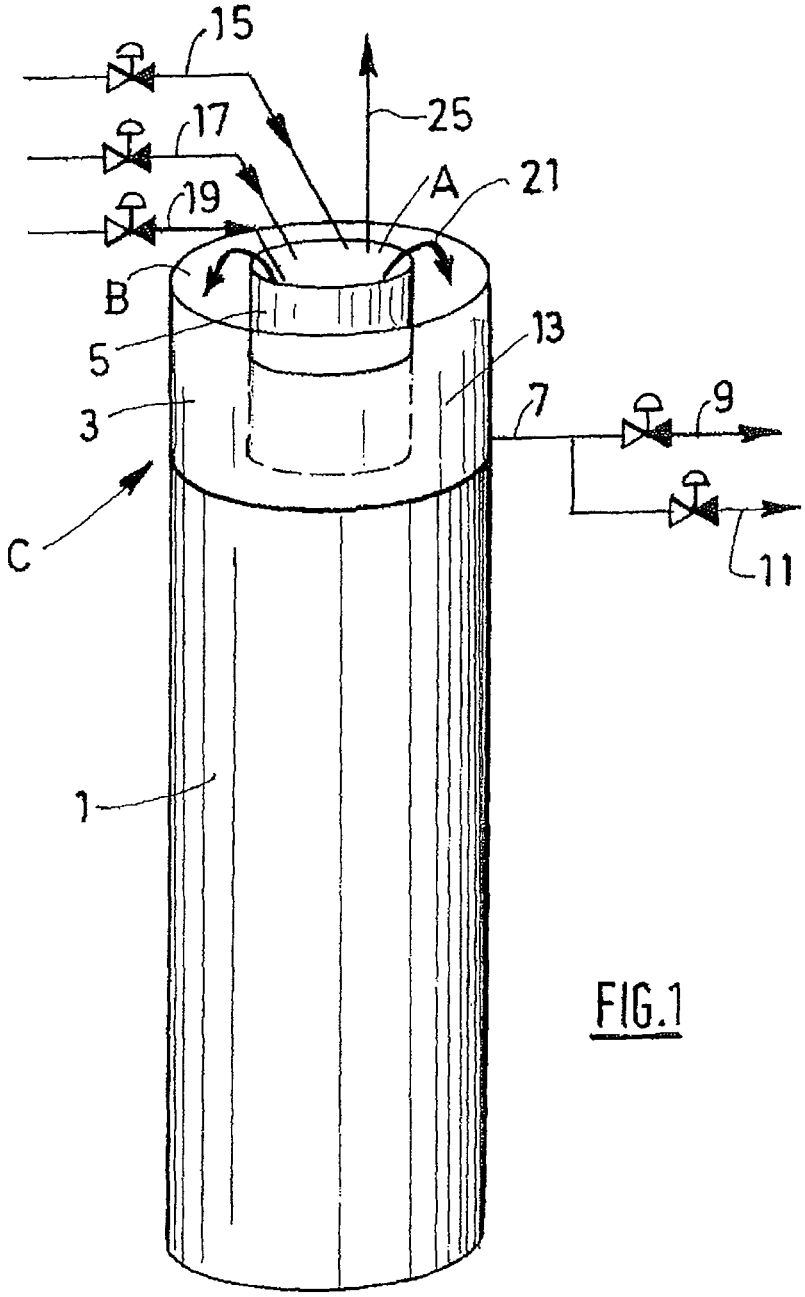
FIG. 1 illustrates an enclosure and a column in accordance with one embodiment of the present invention.

For a further understanding of the nature and objects for the present invention, reference should be made to the detailed description, taken in conjunction with the accompanying drawing, in which like elements are given the same or analogous reference numbers and wherein:

In FIG. 1, a column 1 is surmounted by a top condenser 3 supplied with a column head gas. This gas condenses at least partially in the condenser 3 and is returned to the top of the column. The condenser 3 is surrounded by a cylindrical barrier 5 sealingly attached to the base of a cylindrical chamber 21 containing the condenser. The barrier and chamber are substantially concentric with the condenser 3. The barrier 5 is lower than the chamber 21. Alternatively or additionally, the barrier may comprise cutouts at the top of the wall allowing the passage of liquid.

The barrier divides the chamber into two parts A and B, the first part A being located between the condenser and the barrier 5 and the second part B being located between the barrier 5 and the wall of the chamber 21.

Lines 15, 17, 19 feed the first part A and a line 7 is attached to the second part B, then being divided into lines 9, 11.

When in service, the condenser is fed with liquid from at least one of the lines 15, 17, 19. This liquid is partially vaporized and the vapor 25 thus formed is withdrawn from the chamber 21. When the liquid level reaches the top of barrier 5, the liquid collected overflows and falls into the second part B.

Figure 2:
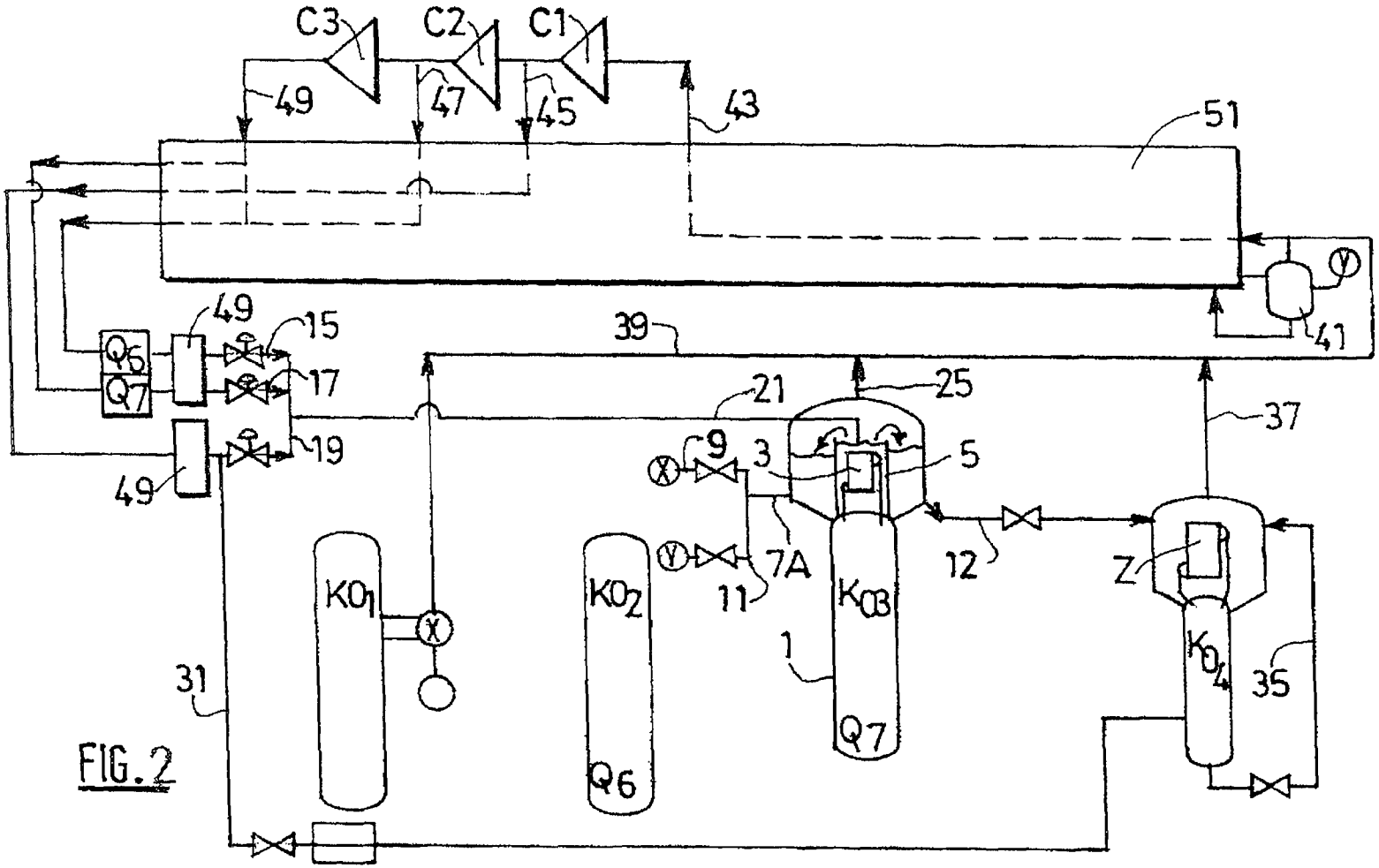
FIG. 2 schematically illustrates an apparatus for producing carbon monoxide by cryogenic separation in accordance with one embodiment of the present invention.

In FIG. 2, the enclosure shown operates as described above and has the same structure as the one described for FIG. 1. The method in FIG. 2 is a methane scrubbing method comprising a methane scrub column K01, a stripping column K02, a column for separating carbon monoxide and methane K03 and a column for separating carbon monoxide and nitrogen K04. The streams supplying the columns and produced by the columns are not shown for the sake of simplification. Conventional apparatus which are suitable for operating according to the invention are shown in "Herstellung von Kohlenmonoxyd and Wasserstoff aus Erdgas" by Linde Berichte 33/1973, Ullmann's Encyclopedia of Industrial Chemistry, 5$^{th}$ edition, page 270, "Progress in H2/CO Low Temperature Separation" by Berninger, Linde Berichte, 44/1988, pages 20-21, Tieftemperaturtechnik, 2$^{nd}$ edition, pages 417-418, Research Disclosure 42654 of October 1999, DE-A-3741906, FR-A-2015667, US2002/134243, U.S. Pat. Nos. 6,269,657, 6,094,938, 6,082,134, 6,073,461, 6,062,042, 5,592,831, 5,295,356, 5,133,793 and 4,888,035.

It can be easily understood that the method could comprise fewer columns or more columns. In particular, the column for separating carbon monoxide and nitrogen is not an essential element of the invention.

In short, the column K01 is fed with a feed stream, a fluid from the column depleted of hydrogen is sent to the stripping column K02, the liquid from the bottom of the stripping column is sent to the $CO/CH_4$ separating column K03 and the column K04 is fed with a fluid from the column K03, for producing pure carbon monoxide at the top of the column K04.

The enclosure C is fed with a liquid 21 from at least two different sources but substantially having the same composition. This liquid is rich in carbon monoxide. The liquid 15 sent to the first part of the chamber issues from the reboiler Q6 of the stripping column K02. The liquid 17 sent to the first part of the chamber issues from the reboiler Q7 of a column for separating carbon monoxide and methane.

The liquid 19 sent to the first part of the chamber issues from the heat exchanger 49.

The liquid which has overflowed the barrier is divided into three parts. Part X is sent to a heat exchanger for cooling the scrub column K01. Part Y is sent to a pot 41 and then to the main heat exchange line where the mixture fed to the apparatus is cooled. Part 7 is sent to the top condenser of the CO/nitrogen separating column K04. Part X evaporates in the cooling heat exchanger to form a stream 39. It is mixed with the vaporized streams 25, 37 from the condensers of the column K03 and the column K04 respectively. The mixed stream 43 joins the top gas of the separator pot 41 and is cooled in the heat exchanger 51.

This stream 43 is compressed by a compressor C1. A compressed part 45 is sent to the heat exchanger 49 and is then divided, the part 31 feeding the column K04 and the remainder constituting the stream 19.

The rest of the stream 43 is compressed in the compressor C2 to partly form the stream 47 which, cooled in the heat exchanger 51, becomes the stream 15 sent to the enclosure C. The compressor C3 compresses the rest of the stream to form the stream 49 which is divided into two. Part of the stream is mixed with the stream 49 and the remainder becomes the stream 17.

Figure 3:
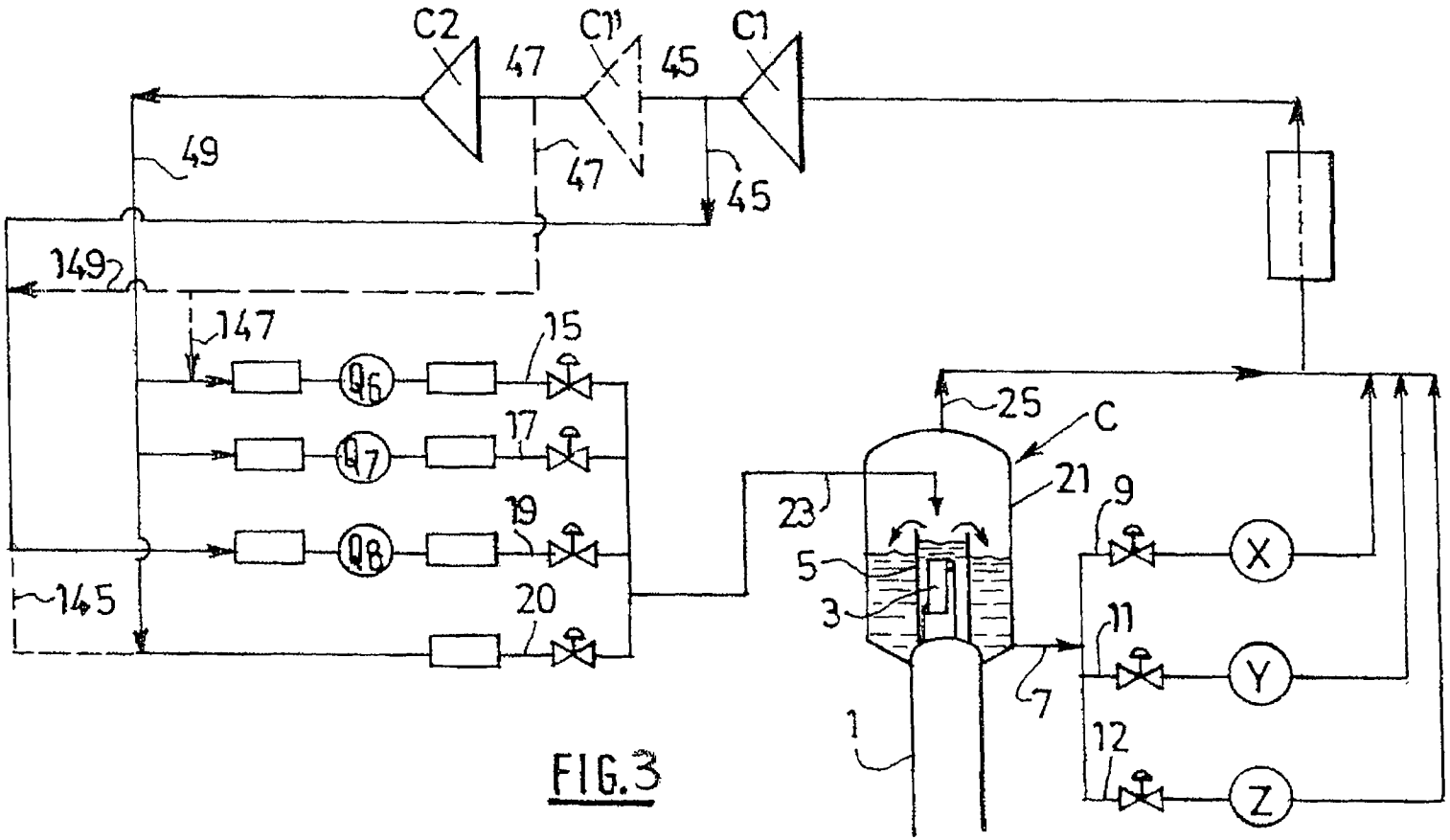
FIG. 3 schematically illustrates an apparatus for producing carbon monoxide by cryogenic separation in accordance with one embodiment of the present invention.

In FIG. 3, the enclosure shown operates as described above and has the same structure as the one described for FIG. 1. The method in FIG. 3 may be a method for methane scrubbing comprising at least one stripping column, a column for separating carbon monoxide and methane and a column for separating carbon monoxide and nitrogen.

It can be easily understood that the method could comprise fewer columns or more columns.

For example, in the case of a methane scrubbing process, the apparatus comprises a methane scrub column.

The enclosure C is fed with liquid issuing from at least two different sources but substantially having the same composition. This liquid may, for example, be a liquid rich in carbon monoxide, rich in nitrogen or a mixture mainly containing hydrogen and carbon monoxide. The liquid 15 sent to the first part of the chamber issues from the reboiler Q6 of a stripping column. The liquid 17 sent to the first part of the chamber issues from the reboiler Q7 of a column for separating carbon monoxide and methane.

The liquid 19 sent to the first part of the chamber issues from the reboiler Q8 of a column for separating carbon monoxide and nitrogen, if any.

The liquid 7 which overflows the barrier is divided into three parts 9, 11, 12. Part 9 is sent to a heat exchanger for cooling a scrubbing column, if any. Part 11 is sent to the main heat exchange line where the mixture feeding the apparatus is cooled. Part 12 is sent to the top condenser of a column other than column 1, for example a column for separating carbon monoxide and nitrogen, like the column K04 in FIG. 2.

Each of these parts 9, 11, 12 is vaporized and is mixed with the vaporized liquid 25 issuing from the condenser 3. The mixed stream forms a cycle gas which is compressed in a multistage compressor, called compressor C1, C1' and C2 connected in series. Compressor C1 compresses the gas to form a stream 45 which becomes the stream 19 downstream of the reboiler Q8. There may be a compressor C1' which forms a stream 47 which is partly sent (147) to the reboiler Q6 and partly (149) to the reboiler Q8. The compressor C2 produces a stream 49 which feeds the reboilers Q6, Q7, the remainder forming the stream 20 also sent to the condenser 13.

Figure 4:
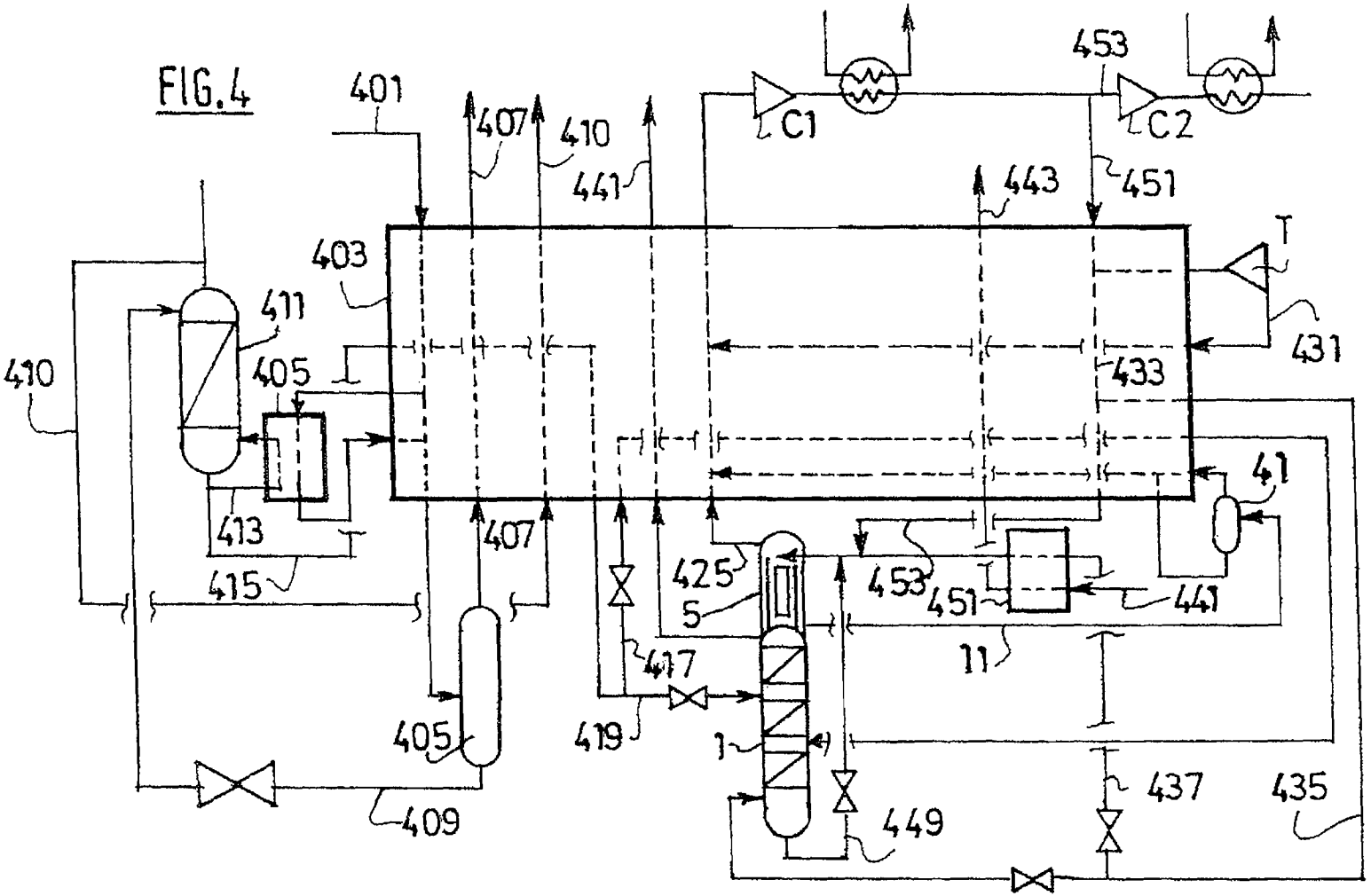
FIG. 4 schematically illustrates an apparatus for producing carbon monoxide by cryogenic separation in accordance with one embodiment of the present invention.

The method in FIG. 4 shows a method for producing carbon monoxide and hydrogen by partial condensation.

The apparatus comprises a separator pot 405, a stripping column 411 and a column for separating carbon monoxide and nitrogen 1. The column 1 comprises a storage enclosure according to the invention.

A stream of synthesis gas 401 containing nitrogen but substantially without methane is cooled in the heat exchange line 403. Part of the synthesis gas is used to reboil the stripping column 411 using the reboiler 405. The partially condensed synthesis gas leaves the heat exchange line 403 and is sent to the separator pot 405. The top gas 407 is heated in the heat exchange line and serves as a hydrogen-rich product. The liquid 409 is sent to the top of the stripping column 411. The top gas 410 from the stripping column 411 leaves the apparatus after heating in the heat exchange line 403. The bottom liquid 415 of the stripping column 411 is sent to an intermediate point of the heat exchange line 403 where it cools and is divided into two. One part 419 is sent to the separation column 1 after expansion. The remainder 417 is heated in the heat exchange line and is sent to the separating column 1 at a lower level. The bottom liquid 449 from the separating column 1 is sent to the top condenser thereof where it is partially vaporized. The vaporized liquid rich in carbon monoxide 425 is sent to the heat exchange line 403 to be heated and then to the compressor C1. The carbon monoxide is cooled with water. A part 453 serves as a product after a compression step in the compressor C2. The remainder 451 is cooled in the heat exchange line. A part 431 is expanded in the turbine T to supply the refrigerating capacity for the separation and recycled to the compressor C1. The remainder 433 is divided into two. A part 435 is sent at an intermediate temperature of the heat exchange line 403 at the bottom of the column 1 and to the top condenser (stream 437) after cooling in the heat exchanger 451 against a stream of liquid injection of liquid nitrogen 441. The remainder 453 is sent to the condenser at the temperature of the cold end of the heat exchange line 403.

The cycle gas compressed in the compressor C1 may be a gas rich in carbon monoxide, a nitrogen-rich gas or a gas mixture of hydrogen and carbon monoxide.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A liquid storage enclosure, suitable for inclusion in a cryogenic separation apparatus, said liquid storage enclosure comprising;

a) a chamber;

b) a heat exchanger disposed inside the chamber;

c) a barrier dividing the chamber into a first part and a second part;

i) the heat exchanger disposed in the first part and the second part being arranged around the first part;

ii) the barrier having a lower height than the height of the chamber, at least at certain points, for allowing liquid to pass from the first part to the second part over the barrier, when the enclosure is in service;

d) means for sending liquid into the first part of the chamber;

e) means for withdrawing liquid from the second part of the chamber;

f) means for sending a fluid to the heat exchanger; and g) means for withdrawing a fluid from the heat exchanger.

2. The liquid storage enclosure of claim 1, wherein the barrier is sealingly attached to the base of the chamber.

3. A distillation column comprising a liquid storage enclosure as claimed in claim 1, in which the heat exchanger is a bottom reboiler or a top condenser.

4. An apparatus for producing carbon monoxide and/or hydrogen by cryogenic separation, comprising an enclosure as claimed in claim 1, said enclosure being included in a separator pot.

5. An apparatus for producing carbon monoxide and/or hydrogen by cryogenic separation, comprising a column as claimed in claim 3, in which the column is a column for separating carbon monoxide and methane or a column for separating carbon monoxide and nitrogen.

6. The apparatus of claim 5, further comprising means for sending liquid into the first part issuing from at least two different sources and/or means for withdrawing liquid from the second part to send it subsequently to two different destinations.

7. The apparatus of claim 6, further comprising a scrub column and means for sending the withdrawn liquid at least to the cooler of the scrub column.

8. The apparatus of claim 6, further comprising a heat exchange line; means for sending fluid from the apparatus to the heat exchange line to be cooled therein; and means for sending the withdrawn liquid at least to the heat exchange line.

9. The apparatus of claim 6, further comprising:

a column configured to separate:

i) carbon monoxide and methane, or ii) carbon monoxide and nitrogen; and means for sending the withdrawn liquid at least to a top condenser of the column.

10. The apparatus of claim 6, further comprising a stripping column having a bottom reboiler and means for sending liquid condensed in the bottom reboiler to the first part of the enclosure.

11. The apparatus of claim 6, further comprising a column for separating carbon monoxide and nitrogen having a bottom reboiler and means for sending liquid condensed in the bottom reboiler to the first part of the enclosure.

12. The apparatus of claim 6, further comprising a column for separating carbon monoxide and methane having a bottom reboiler and means for sending liquid condensed in the bottom reboiler to the first part of the enclosure.

13. The apparatus of claim 6, further comprising a heat exchange line and means for sending a liquid from the heat exchange line to the first part of the enclosure.

14. A method for producing carbon monoxide and/or hydrogen by cryogenic separation in an apparatus comprising an enclosure as claimed in claim 1, said enclosure being included in a separator pot.

15. A method for producing carbon monoxide and/or hydrogen by cryogenic separation in an apparatus comprising a column as claimed in claim 3, in which the column is a column for separating carbon monoxide and methane or a column for separating carbon monoxide and nitrogen.

16. The method of claim 14, in which liquid is sent into the first part issuing from at least two different sources and/or liquid is withdrawn from the second part to send it subsequently to two different destinations.

* * * * *